US006086719A

United States Patent [19]

Hasegawa et al.

[11] Patent Number: 6,086,719

[45] Date of Patent: Jul. 11, 2000

[54] SHOE PRESS BELT AND METHOD OF MANUFACTURE

[75] Inventors: Yasuo Hasegawa, deceased, late of Nagareyama, Japan, by Sachie Hasegawa, Takashi Hasegawa, Atsushi Hasegawa, heirs; Minenari Imada, Kashiwa, Japan

[73] Assignee: Ichikawa Co., Ltd., Tokyo, Japan

[21] Appl. No.: 09/257,558

[22] Filed: Feb. 25, 1999

[30] Foreign Application Priority Data

Feb. 26, 1998 [JP] Japan ..... 10-062215

[51] Int. Cl.[7] ..... D21F 3/00; B29D 22/00; B32B 1/08; F16G 1/00; B31C 3/16

[52] U.S. Cl. ..... 162/358.4; 162/358.2; 162/901; 428/36.2; 428/36.3; 156/137; 156/141; 156/172

[58] Field of Search ..... 428/35.7, 34.1, 428/36.1, 36.2, 36.3, 36.8, 36.9, 36.91; 156/171, 172, 137, 140, 141; 162/358.2, 358.1, 358.4, 901, 900; 198/844.1, 846, 848, 847; 139/383 R, 387 R

[56] References Cited

U.S. PATENT DOCUMENTS 4,944,820 7/1990 McCarten ..... 156/154
5,062,924 11/1991 McCarten et al. ..... 162/358
5,968,318 10/1999 Hasegawa et al. ..... 162/358.4

FOREIGN PATENT DOCUMENTS 64-45889 2/1989 Japan .
1-503315 11/1989 Japan .
1-298292 12/1989 Japan .
3-57236 8/1991 Japan .
5-505428 8/1993 Japan .
8-209578 8/1996 Japan .

*Primary Examiner*—Stanley S. Silverman
*Assistant Examiner*—Dionne A. Walls
*Attorney, Agent, or Firm*—Howson & Howson

[57] ABSTRACT

A shoe press belt for papermaking comprises an endless first resin layer formed on a polished surface of a mandrel; a base fabric layer comprising a woven fabric leaf arranged over the entire outer periphery of the first resin layer, at least one of the sets of intersecting threads of the fabric leaf being high-strength threads extending axially along the mandrel; a bobbin layer comprising high-strength thread circumferentially wound in a spiral on the outer periphery of the base fabric layer; and an endless second resin layer on the outer periphery of the bobbin layer, the second resin layer being in contact with the first layer through the base fabric layer and the bobbin layer. The shoe press belt constructed in this manner exhibits high strength in the machine direction as well as in the cross machine direction.

4 Claims, 4 Drawing Sheets

SHOE PRESS BELT AND METHOD OF MANUFACTURE

BRIEF SUMMARY OF THE INVENTION

This invention relates a shoe press of the kind used in paper manufacture, and more particularly to a belt for use in a closed type shoe press, and a method of manufacturing the belt.

The use of shoe presses in paper manufacture has been increasing because it reduces the number of press units required in the press area. The closed type shoe press has been particularly popular because it takes up only a relatively small space and minimizes oil scattering.

However, in the paper making process, a belt for use in the closed type shoe press, undergoes more severe working conditions than a belt for use in an open type shoe press. The more severe working conditions include higher operating speeds and higher nip pressures. For these reasons, users require the belts for closed type shoe presses to have improved durability.

For manufacturing the closed type belt, several manufacturing techniques using a mandrel are known. For example, Japanese Patent Publication No. 57236/1991 and Japanese laid-open patent application No. 45889/1989 describe methods using an endless woven fabric for core material. With these methods, however, it is difficult to achieve alignment in the circumferential direction.

Manufacturing methods which do not use woven fabric are described in International patent application 503315/1989 and laid-open Japanese patent application No. 209578/1996. In these manufacturing methods, a high-strength thread is stretched at regular intervals over the entire periphery of a mandrel in the cross machine direction (CMD). These methods have the drawback that it takes a very long time to stretch the high-strength thread.

In still another known manufacturing method, a mat-shaped fibrous belt or a woven fabric, impregnated with uncured resin, is wound in a spiral around a mandrel for curing. This method has been disclosed in laid-open Japanese patent application No. 298292/1989 and International patent application No. 505428/1993. This method has the drawback that peeling can occur at the spiral line defining the juncture between successive turns of the spirally wound fibrous belt or fabric.

In accordance with a conventional manufacturing method, while an endless woven fabric extends between a pair of rolls, its outer surface is impregnated and coated, by a coating machine, with a first resin layer, which is cured. Thereafter the endless woven fabric is removed from the rolls, turned inside out and returned to the rolls. The outer surface of the inside-out woven fabric is impregnated and coated with a second resin layer, which is also cured. The overall thickness is adjusted, and thereafter concave grooves are formed in the second resin layer to complete the belt.

The above-described conventional method has two significant drawbacks. First, to impregnate and coat the back of the endless woven fabric with the second resin layer, it is necessary to turn the belt inside-out. The process of turning the belt inside-out produces a strain within the belt. Second a strain inherent in the endless woven fabric as a result of the weaving process, is released when the resin is cured. The release of the inherent strain resulting from the weaving process can result in an unstable form, and flapping of the belt may occur in use.

Thus, the conventional closed type shoe press belt has had various inherent drawbacks. In addition, when a belt is produced by extending an endless woven fabric between two rolls, and tension is applied in the CMD direction in use, dimensional variations in the CMD direction readily occur. Such dimensional variations are a leading cause of shortened belt life.

The principal object of the invention is to correct the above-described defects and to provide a shoe press belt with excellent performance and durability, having high strength in the machine (MD) direction as well as in the CMD direction, and superior dimensional stability in the CMD direction.

The shoe press belt in accordance with the invention comprises an endless first resin layer having a smooth internal surface in the form of a surface of revolution, e.g. a cylinder. Preferably, the smooth internal surface is produced by forming the first resin layer on a polished surface of a rotatable mandrel. The belt also includes a base fabric layer comprising a woven fabric leaf arranged over the entire outer periphery of the first resin layer, at least one of the sets of intersecting threads of the fabric leaf being high-strength threads extending axially along the base fabric layer. The term "extending axially" means disposed in a common plane with the axis but not perpendicular to the axis. The shoe press belt also includes a bobbin layer comprising high-strength thread circumferentially wound in a spiral on the outer periphery of the base fabric layer, and an endless second resin layer on the outer periphery of the bobbin layer, the second resin layer being in contact with the first layer through the base fabric layer and the bobbin layer. The shoe press belt constructed in this manner exhibits sufficient strength in the machine direction (MD) direction as well as in the cross machine direction (CMD).

The method for manufacturing a shoe press belt in accordance with the invention comprises the steps of: forming an endless first resin layer on a polished surface of a rotatable mandrel; forming a base fabric layer by arranging, over the entire outer periphery of the first resin layer, a woven fabric leaf, at least one of the sets of intersecting threads of which consists of high-strength threads, so that the threads of said one of the sets extend along the axial direction of the mandrel; forming a bobbin layer by winding high-strength thread onto the outer periphery of the base fabric layer circumferentially in a spiral; and thereafter forming an endless second resin layer on the outer periphery of the bobbin layer so that it comes into contact with the first resin layer through the base fabric layer and the bobbin layer. This simple method of construction provides a shoe press belt having superior performance.

Other objects and advantages of the invention will be apparent from the following detailed description.

BRIEF DESCRIPTION OF THE DRAWINGS

FIG. 8(*b*) is a partial cross-sectional view showing a shoe press obtained by the conventional method.

DETAILED DESCRIPTION

Figure 2A:
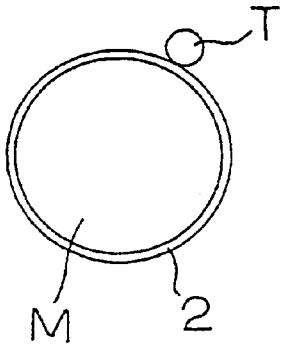
FIG. 2(*a*) and FIG. 2(*b*) are respectively a side cross-sectional view and a perspective view of a mandrel illustrating the formation of a first resin layer.
Figure 2B:
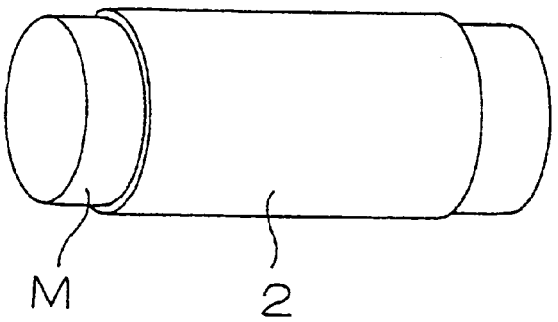

As shown in FIG. 2, a first resin layer 2 is formed on the polished surface of a mandrel M, The surface of the mandrel M is coated with a release agent (not shown), or, alternatively, a release sheet (not shown) is adhered to the mandrel. On top of the release layer or release sheet, the resin layer is formed to a thickness preferably in the range from about 0.5 mm to about 2.0 mm, using a coating machine such as a doctor bar or coater bar T as shown in FIG. 2(*a*).

Figure 3:
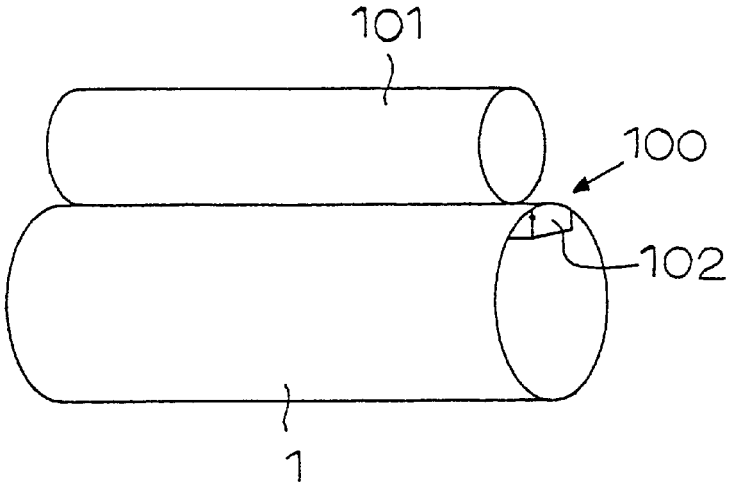
FIG. 3 is a perspective view showing a shoe press mechanism utilizing a belt in accordance with the invention.

As shown in FIG. 3, a belt 1 is passed between a press roll 101 and a shoe 102 in a shoe press mechanism 100. The first resin layer 2, constituting the innermost layer of the belt 1, glides over the shoe 102 while it is in tight contact with the shoe. Therefore, the inner surface of the belt must have a high level of smoothness. Since this high level of smoothness results from the polished surface of the mandrel M, no post-treatment of the belt is required.

The surface of the mandrel M is polished not only to ensure the smoothness of the innermost layer of the belt, but also to improve the release property of the belt. The mandrel M is also preferably provided with a heating device (not shown) to promote curing of the resin layer 2 and also to promote curing of a later-applied resin layer.

Figure 4:
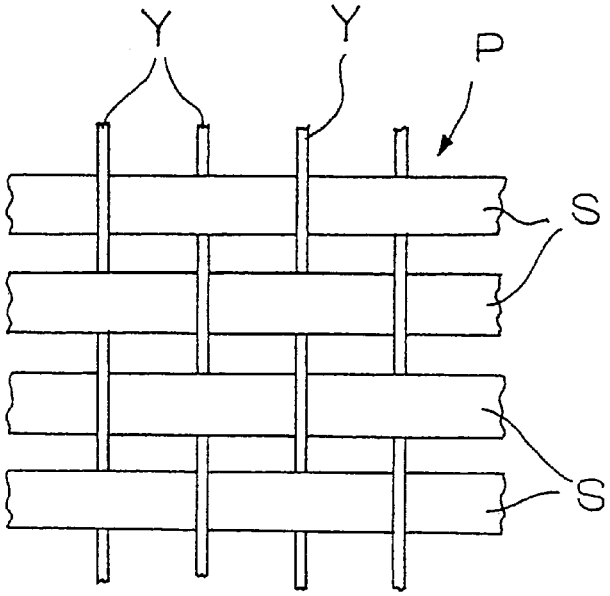
FIG. 4 is a partial plan view of a woven fabric leaf for use in a base fabric layer.

A base fabric layer 3 is arranged on the outerperiphery of the first resin layer 2. Referring to FIG. 4, the base fabric layer 3 is formed by a woven fabric leaf P. The fabric leaf P comprises intersecting sets of threads S and Y. At least threads S are high-strength threads. Threads Y can be, but need not be, high strength threads.

Figure 5:
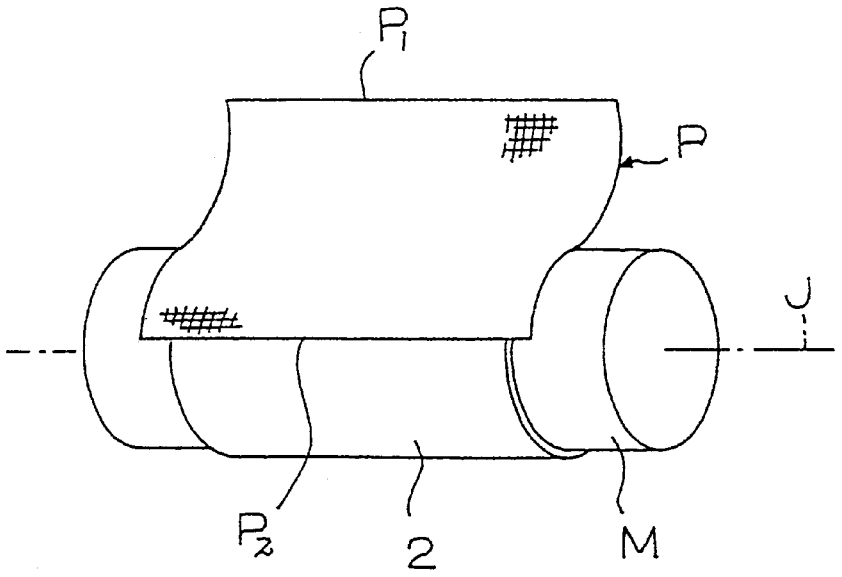
FIG. 5 is a perspective view showing a process of arranging a single woven fabric leaf, which becomes a base fabric layer, on the outer surface of a first resin layer formed on the mandrel surface.

As shown in FIG. 5, the woven fabric leaf P is arranged over the entire outer periphery of the first resin layer 2, and is arranged so that the high strength treads S extend along the direction of the axis J of the mandrel M.

The high-strength threads S of the woven fabric leaf extend along the axial direction of the mandrel i.e. the direction of the width of the belt. Non-high strength thread may be used for the intersecting threads Y. Even if high-strength thread is not used for both threads constituting the woven fabric leaf P, the high strength threads S impart strength to the belt in the CMD direction.

Figure 6:
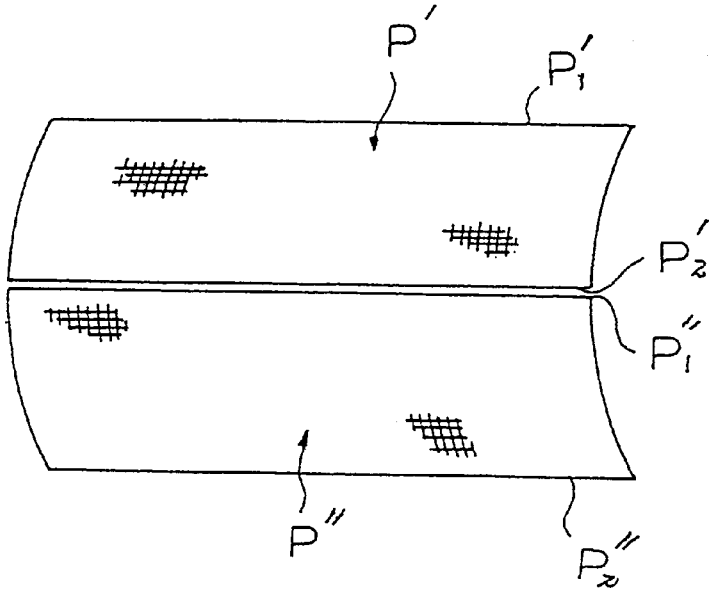
FIG. 6 is a perspective view showing a multi-sheet woven fabric which becomes a base fabric layer.

The woven fabric leaf P, can be a single woven fabric leaf, as shown in FIG. 5, extending around the outer periphery of the first resin layer 2 once and covering the entire first resin layer 2, with the edges P1 and P2 of the fabric leaf meeting each other in opposed relationship. Alternatively, the woven fabric leaf can be a multi-sheet leaf, as shown in FIG. 6, covering the outer periphery of the first resin layer 2 with the edges P1' and P2" meeting each other and with edges P2' and P1" meeting each other. Either the single sheet woven fabric leaf or the multi-sheet fabric leaf can be used. However, the multi-sheet fabric leaf is easier to work.

Figure 1:
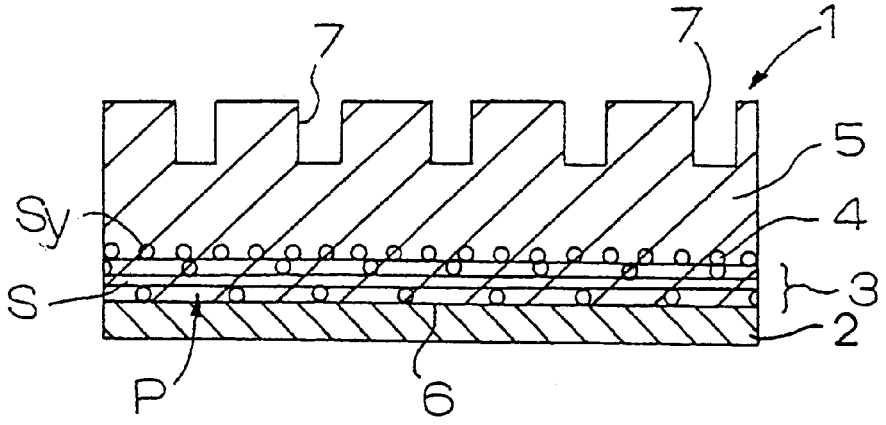
FIG. 1 is a partially enlarged cross-sectional view showing a belt in accordance with the invention.
Figure 7:
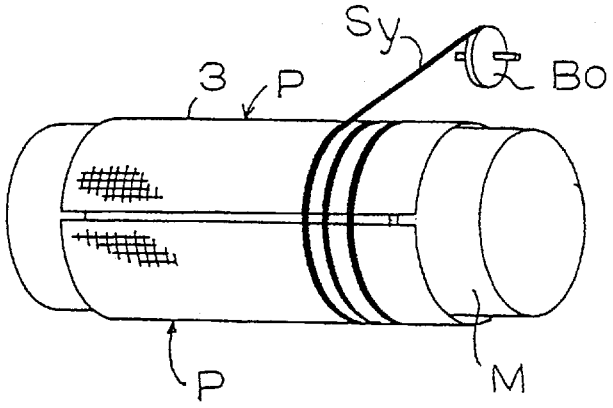
FIG. 7 is a perspective view showing the formation of a bobbin layer.

Again referring to FIG. 1, a bobbin layer 4 is formed on the outer periphery of the base fabric layer 3. The bobbin layer 4 comprises high-strength thread Sy wound about the base fabric layer circumferentially in a spiral. (In the case of a cylindrical mandrel, the spiral will be a helix.) As shown in FIG. 7, the bobbin layer is obtained by winding the high-strength thread Sy around the base fabric layer 3 in a spiral from bobbin Bo while rotating the mandrel M. The bobbin layer is wound over the entire area of the base fabric layer 3. There are cases in which a plurality of bobbins may be used to wind a plurality of threads to form the bobbin layer. The bobbin layer 4 is effective to impart strength to the belt 1 in the circumferential direction (MD direction).

An endless layer 5 of a second resin is formed on the outer periphery of bobbin layer 4. The base fabric layer 3 and the bobbin layer 4 are impregnated with the second resin layer 5 so that the second resin layer comes into contact with the outer surface of the first resin layer 2 at a contact surface 6. At the contact surface 6 the first and second resin layers are melted and made integral with each other. A primer or adhesive may be used to improve the integration if necessary.

The resin used for the first resin layer 2 and the second resin layer 5 can be selected from among rubber and other elastomers. Polyurethane resin is preferred. As the polyurethane resin, thermosetting urethane is preferable in view of its physical properties, and it can be selected within a range of 80 to 98° in hardness (JIS-A). The first resin layer 2 and the second resin layer 5 may be the same or different from each other in hardness.

The high-strength thread S, as shown in FIG. 4, used for at least one of the sets of intersecting threads in the woven fabric P of the base fabric layer 3, is a comparatively thick, upright thread, for example, monofilament yarn, multifilament yarn corresponding to 800 to 6000 denier, or a twisted yarn. Such a yarn imparts the needed strength to the belt 1 in the CMD direction. The threads Y, intersecting the high-strength threads S, are capable of supporting the thread S so that the interval between threads S does not deviate. The texture of the woven fabric leaf P is not important, but weft double, weft triple or single texture are preferably used.

The material for the high-strength thread S is preferably a synthetic fiber having high modulus and a high modulus of elasticity, such as nylon, polyester, aromatic polyamide, aromatic polyimide, or high strength polyethylene. Also inorganic fiber such as carbon fiber and glass fiber can be used. The strength of the thread material is preferably within a range of 120 to 250 kg/cm, and the thread material is preferably within a range of 10 to 40 kg/cm in 1% modulus.

In arranging the woven fabric leaf P on the outer periphery of the first resin layer 2, the mandrel is caused to rotate little by little. The woven fabric leaf P is arranged so that the high-strength thread S is parallel with the axial direction of the mandrel, and is caused to bond compressively before the first resin layer 2 is cured, i.e. while it still retains a glue-like property.

In the above-described case. When the woven fabric P is a single leaf, its length is adjusted to 99.7% to 100% of the circumference of the first resin layer 2, and it wrapped once around the first resin layer 2 so as to cover the entire first resin layer. The process of fixing the woven fabric layer to the first resin layer can be made easier by forming the fabric layer so that circumferential threads Y extend beyond the ends of the fabric leaf, and combining the extending threads with one an other. Also, when the woven fabric leaf P is a multi-sheet leaf, it is important to be careful not to open the interval between the end portions excessively and not to overlap the end portions excessively.

As in the case of the high-strength thread S, the material for the high-strength thread Sy used for the bobbin layer 4 can be monofilament yarn, multifilament yarn or twisted yarn, consisting of synthetic fiber having high tenacity, high modulus and high modulus of elasticity, such as nylon, polyester, aromatic polyamide, aromatic polyimide, or high-strength polyethylene.

It is preferable to produce the high-strength thread Sy so that the final product has a strength of 170 to 250 kg/cm by winding in at 20 pieces to 50 pieces/5 cm for nylon or PET multifilament (4500 d), or by winding in at 10 pieces to 30 pieces/5 cm for multifilament (3000 d) consisting of aromatic polyamide.

The second layer 5 can be formed, after the bobbin layer 4 is formed by winding the high-strength thread Sy. Alternatively, the second layer 5 can be formed while the high-strength thread Sy is being wound in. After the second resin layer 5 is formed and the resin is cured, the surface is polished to achieve the target thickness of the belt, and a concave groove 7 is formed on the surface as required to obtain the belt 1. Alternatively, the groove can be a blind hole, i.e. a recess with a circular cross-section. Thereafter the belt is removed from the mandrel M. The belt can be removed form the mandrel easily by using a release agent or a release sheet provided in advance on the mandrel surface. Other techniques for removal include the utilization of hydraulic pressure, and making use of the expansion and shrinkage of the resin.

An example of a shoe press belt and method of its manufacture in accordance with the invention is as follows.

A polished surface of a mandrel having a diameter of 1500 mm, and rotatable by appropriate drive, is coated with a release agent (KS-61: produced by The Shin-Etsu Chemical). The mandrel surface is coated with a thermosetting urethane resin comprising, as a prepolymer, Takenate L2395 produced by Takeda Chemical, and as a curing agent, 3, 3'-dichloro-4, 4'1-diaminodiphenylmethane, at a thickness of 1 mm using a doctor bar, and is left alone for 10 minutes.

Next, a woven fabric leaf P is wound around the outer periphery of the first resin layer. The woven fabric leaf has a weft mesh of 30 pieces/5 cm and a warp mesh of 40 pieces/5 cm. It comprises monofilament yarns of 800 d polyester as the warp, and multi-filament yarn (the high-strength thread S) of 4500 d polyester as the weft. The yarns are woven in a weft double weaving, so that the multi-filament yarns (the high-strength threads S) extend along the axial direction of the mandrel. The woven fabric leaf and the first resin layer are bonded compressively with the ends of the woven fabric leaf placed opposite to each other.

After the base fabric layer 3 is formed on the outer periphery of the first resin layer 2, a multi-filament yarn of 4500 d polyester(the high-strength thread Sy) is wound around the outer periphery of the base fabric layer circumferentially in a spiral at a pitch of 30 pieces/5 cm to form the bobbin layer 4.

Next, the bobbin layer is coated and impregnated with the same thermosetting urethane resin as was used for the first resin layer 2 to a thickness of 5.5 mm above the bobbin layer 4, and is heated and cured at 100° C. for five hours to form the second resin layer 5. Thereafter, the surface of the second resin layer 5 is polished to obtain an overall thickness of 5.2 mm, and then a concave groove 7 is formed in the circumferential direction with a rotating blade to complete the formation of the belt 1.

Figure 8A:
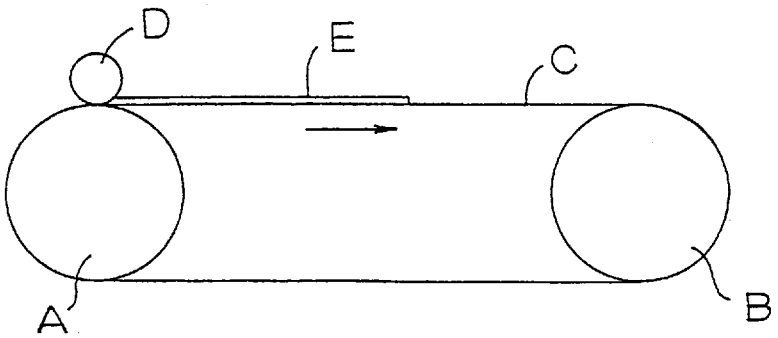
FIG. 8a PRIOR ART
FIG. 8(*a*) is a side cross-sectional view showing the conventional process for manufacturing a shoe press belt.
Figure 8B:
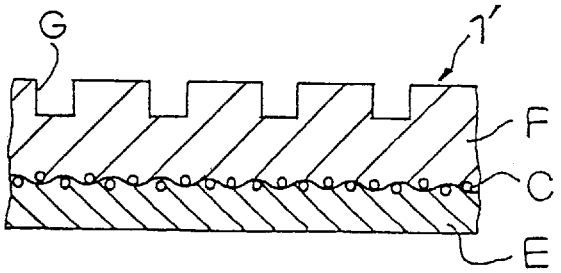
FIG. 8b PRIOR ART

For comparison, a conventional shoe press belt 1', as depicted in FIG. 8(*b*) was also formed by the process depicted in FIG. 8(*a*). An endless woven fabric C (i.e., a woven fabric produced by endless weaving) was looped between two rolls A and B. The outer surface of the woven fabric C was impregnated and coated with a first resin layer by a coating machine D, and the first resin layer was heated and cured, and then polished to form layer E. Thereafter the endless woven fabric C was removed from the rolls A and B, turned inside out, and again looped between the rolls A and B. The outer surface of the woven fabric was then impregnated and coated with a second resin layer F and the second resin layer was heated and cured at 100° C. for five hours to form the second resin layer F. The second resin layer F was polished to an overall thickness of 5.2 mm, and then a concave groove G was formed in the circumferential direction using a rotating blade to complete the belt 1'.

A thermosetting urethane resin was used for both resin layers, comprising, as a prepolymer, Takenate L2395 (produced by Takeda Chemical), and as a curing agent, 3,3'-dichloro-4, 4'-diaminodiphenylmethane.

Physical properties and production time (between the formation of the first and second resin layers) were compared with the results shown in the following table.

| | | Belt of this invention | Conventional belt |
|---|---|---|---|
| Warp direction (MD) | Cutting strength | 200 | 186 |
| | Cutting ductility | 15.0 | 14.3 |
| | 1% modulus (kg/cm) | 32.9 | 30.6 |
| Weft direction (CMD) | Cutting strength | 200 | 186 |
| | Cutting ductility | 13.6 | 49.9 |
| | 1% modulus (kg/cm) | 15.2 | 9.7 |
| Time until the second resin layer is formed after the first resin layer is formed (hours) | | 1 | 10 |

The above table shows that the belt of this application is superior in physical properties to the conventional belt with which it was compared. The endless woven fabric used as the base fabric layer for the conventional belt has had unstable belt dimensions resulting from internal strain in the woven fabric caused by irregularities in the arrangement of the weft, elongation or crimping of the weft during weaving, or internal strain due to loads encountered in the process of turning the belt inside-out between the steps of forming the first resin layer and forming the second resin layer. In contrast, since the belt in accordance with the invention has no such internal strain, it is dimensionally stable particularly in the CMD direction.

The above table also shows that the belt of this invention can be manufactured in a shorter time than the conventional belt. Since the conventional belt uses the endless woven fabric, it is turned inside-out to form the second resin layer after the first resin layer is formed. Before the belt is turned inside-out, the first resin layer must be heated and cured, and this takes at least ten hours. In the belt in accordance with this invention, however, there is no need for turning the belt inside-out, or for similar steps, and the interval between the formation of the first resin layer and the formation of the second resin layer is only about one hour. Thus, the belt in accordance with the invention has a greatly shortened manufacturing time.

The shoe press belt according to the invention exhibits the following beneficial effects. First, since the first resin layer constituting the innermost layer of the belt is formed on a polished surface of a mandrel, a smooth surface is formed without the need for post-treatment. Second, since the base fabric layer of the belt is woven fabric leaf having ends, it is easy to adjust dimensions in the circumferential direction during manufacture of the belt, and therefore manufacturing costs are reduced. Third, since the base fabric layer utilizes high-strength threads extending along the axial direction of the mandrel, the belt exhibits sufficient strength in the CMD direction. Therefore, the belt is dimensionally stable in operation and capable of producing product with exceedingly high dimensional precision over a long time. Fourth, since the outer periphery of the base fabric layer of the belt is formed with a bobbin layer made of high-strength thread, the belt also exhibits sufficient strength in the MD direction. Fifth, since the base fabric layer and the bobbin layer are coated and impregnated, and the second resin layer is in contact with the first resin layer, both resin layers become integral with each other. Consequently, destruction of the belt and peeling of the resin layer as a result of stresses acting on the belt during use are greatly reduced. Finally, in the manufacturing method of the invention there is no need for polishing the first resin layer or for turning the first resin layer inside-out after its formation. The avoidance of the need for polishing the first resin layer and for turning it inside-out significantly improves production efficiency.

What is claimed is:

1. A shoe press belt compromising:

an endless first resin layer having a smooth internal surface in the form of a surface of revolution having an axis, the first resin layer having an outer periphery;

a base fabric layer comprising a woven fabric leaf arranged over the entire outer periphery of the first resin layer, the fabric leaf comprising sets of intersecting threads, and at least one of the sets of intersecting threads being high-strength threads extending in the axial direction along the base fabric layer;

a bobbin layer comprising high-strength thread circumferentially wound in a spiral on the outer periphery of the base fabric layer; and an endless second resin layer on the outer periphery of the bobbin layer, the second resin layer being in contact with the first layer through the base fabric layer and the bobbin layer.

2. A shoe press belt according to claim 1, in which the smooth internal surface of the endless first resin layer is in the form of a cylinder, and in which the threads of said at least one of the sets of intersecting threads extend parallel to said axis.

3. A shoe press belt according to claim 1, in which the endless first resin layer is a layer formed on a polished surface of a rotatable mandrel.

4. A method for manufacturing a shoe press belt manufacturing method, comprising the steps of:

forming an endless first resin layer on a polished surface of a rotatable mandrel;

forming a base fabric layer by arranging, over the entire outer periphery of the first resin layer, a woven fabric leaf comprising sets of intersecting threads, at least one of the sets being high-strength threads, so the threads of said one of the sets extend along the axial direction of the mandrel;

forming a bobbin layer by winding high-strength thread onto the outer periphery of the base fabric layer circumferentially in a spiral; and thereafter forming an endless second resin layer on the outer periphery of the bobbin layer so that it comes into contact with the first resin layer through the base fabric layer and the bobbin layer.

* * * * *